US011804665B2

(12) United States Patent
Masumoto

(10) Patent No.: US 11,804,665 B2
(45) Date of Patent: Oct. 31, 2023

(54) CONNECTOR CAPABLE OF SUPPRESSING THE INCLINATION OF A HOUSING

(71) Applicant: SUMITOMO WIRING SYSTEMS, LTD., Mie (JP)

(72) Inventor: Takuya Masumoto, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 75 days.

(21) Appl. No.: 17/395,333

(22) Filed: Aug. 5, 2021

(65) Prior Publication Data

US 2022/0069491 A1 Mar. 3, 2022

(30) Foreign Application Priority Data

Aug. 25, 2020 (JP) ..... 2020-141741

(51) Int. Cl.
*H01R 12/70* (2011.01)
*H01R 12/71* (2011.01)
*H01R 12/58* (2011.01)

(52) U.S. Cl.
CPC ..... *H01R 12/7023* (2013.01); *H01R 12/716* (2013.01); *H01R 12/58* (2013.01)

(58) Field of Classification Search
CPC .. H01R 12/7023; H01R 12/716; H01R 12/58; H01R 12/724; H01R 12/7052; H01R 12/55
See application file for complete search history.

(56) References Cited

U.S. PATENT DOCUMENTS 4,824,398 A * 4/1989 Taylor ..... H01R 12/716 439/83
4,865,555 A * 9/1989 Assini ..... H01R 12/716 439/82
5,071,372 A * 12/1991 Viselli ..... H01R 12/724 439/79
5,692,912 A * 12/1997 Nelson ..... H01R 12/724 439/79
5,704,802 A * 1/1998 Loudermilk ..... H01R 13/7172 439/490
6,312,268 B1 * 11/2001 Chih-Kai ..... H01R 13/508 439/748
2009/0203237 A1 * 8/2009 Demonica ..... H01R 12/7052 439/78

(Continued)

FOREIGN PATENT DOCUMENTS

JP H05-045919 U 6/1993
JP 2007-042626 A 2/2007
JP 2012-204312 A 10/2012

*Primary Examiner* — Peter G Leigh
*Assistant Examiner* — Nelson R. Burgos-Guntin
(74) *Attorney, Agent, or Firm* — Venjuris, P.C.

(57) ABSTRACT

A connector 10 includes a housing 11 to be installed on a circuit board 80. The housing 11 includes a first locking portion 21 and a second locking portion 22. Each of the first and second locking portions 21, 22 includes a resiliently deformable leg portion 27, 28 projecting from a front side to a back side of the circuit board 80 and a locking body 31, 32 protruding from the leg portion 27, 28 in a direction intersecting a projecting direction of the leg portion 27, 28. The locking body 31, 32 has a locking surface 33, 34 lockable to the circuit board 80. The locking surfaces 33, 34 of the first and second locking portions 21, 22 are at different heights in the projecting direction.

7 Claims, 6 Drawing Sheets

(56) References Cited

U.S. PATENT DOCUMENTS

| | | | | |
|---|---|---|---|---|
| 2009/0275222 | A1* | 11/2009 | Wang | H01R 12/7023 439/82 |
| 2011/0039423 | A1* | 2/2011 | Blasick | H01R 24/50 439/65 |
| 2011/0281462 | A1* | 11/2011 | Tonosaki | H01R 12/724 439/592 |
| 2011/0287641 | A1* | 11/2011 | Zhu | H01R 13/24 439/83 |
| 2018/0154849 | A1* | 6/2018 | Okumura | B60R 16/0238 |
| 2019/0229450 | A1* | 7/2019 | Russo | H01R 13/621 |
| 2020/0067218 | A1* | 2/2020 | Kim | H04M 1/0274 |
| 2020/0194915 | A1* | 6/2020 | Kawashima | H01R 12/57 |
| 2020/0280142 | A1* | 9/2020 | Hung | H01R 9/24 |
| 2020/0328565 | A1* | 10/2020 | Wei | H01R 13/73 |
| 2022/0059975 | A1* | 2/2022 | Kojima | H01R 12/724 |
| 2022/0069491 | A1* | 3/2022 | Masumoto | H01R 12/7052 |
| 2022/0085548 | A1* | 3/2022 | Yi | H01R 12/7047 |
| 2022/0231463 | A1* | 7/2022 | Asano | H01R 13/6581 |
| 2022/0255250 | A1* | 8/2022 | Gieski | H01R 13/665 |

* cited by examiner

CONNECTOR CAPABLE OF SUPPRESSING THE INCLINATION OF A HOUSING

CROSS-REFERENCE TO RELATED APPLICATIONS

This application is based on and claims priority from Japanese Patent Application No. 2020-141741, filed on Aug. 25, 2020, with the Japan Patent Office, the disclosure of which is incorporated herein in their entireties by reference.

TECHNICAL FIELD

The present disclosure relates to a connector.

BACKGROUND

A connector disclosed in Japanese Patent Laid-open Publication No. 2012-204312 includes a housing to be installed on a circuit board. A plurality of lock portions are provided to project on a bottom surface of the housing. Each lock portion is locked to a lock mounting portion of the circuit board. In this way, the connector is mounted on a surface of the circuit board. Note that techniques disclosed in Japanese Patent Laid-open Publication No. 2007-042626 and Japanese Utility Model Publication No. H05-045919 are characterized in a mounting structure of a member other than a housing on a circuit board.

SUMMARY

In the case of Japanese Patent Laid-open Publication No. 2012-204312, there is a concern that the lock portions are loosely locked to the lock mounting portion and the housing is inclined with respect to the circuit board, for example, when a plate thickness of the circuit board is small in a tolerance range.

Accordingly, the present disclosure aims to provide a connector capable of suppressing the inclination of a housing with respect to a circuit board.

The present disclosure is directed to a connector with a housing to be installed on a circuit board, wherein the housing includes a plurality of locking portions, each of the plurality of locking portions includes a resiliently deformable leg portion projecting from a front side to a back side of the circuit board and a locking body protruding from the leg portion in a direction intersecting a projecting direction of the leg portion, the locking body has a locking surface lockable to the circuit board, and the plurality of locking portions come in a plurality of types having the locking surfaces at different heights in the projecting direction.

According to the present disclosure, it is possible to provide a connector capable of suppressing the inclination of a housing with respect to a circuit board.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
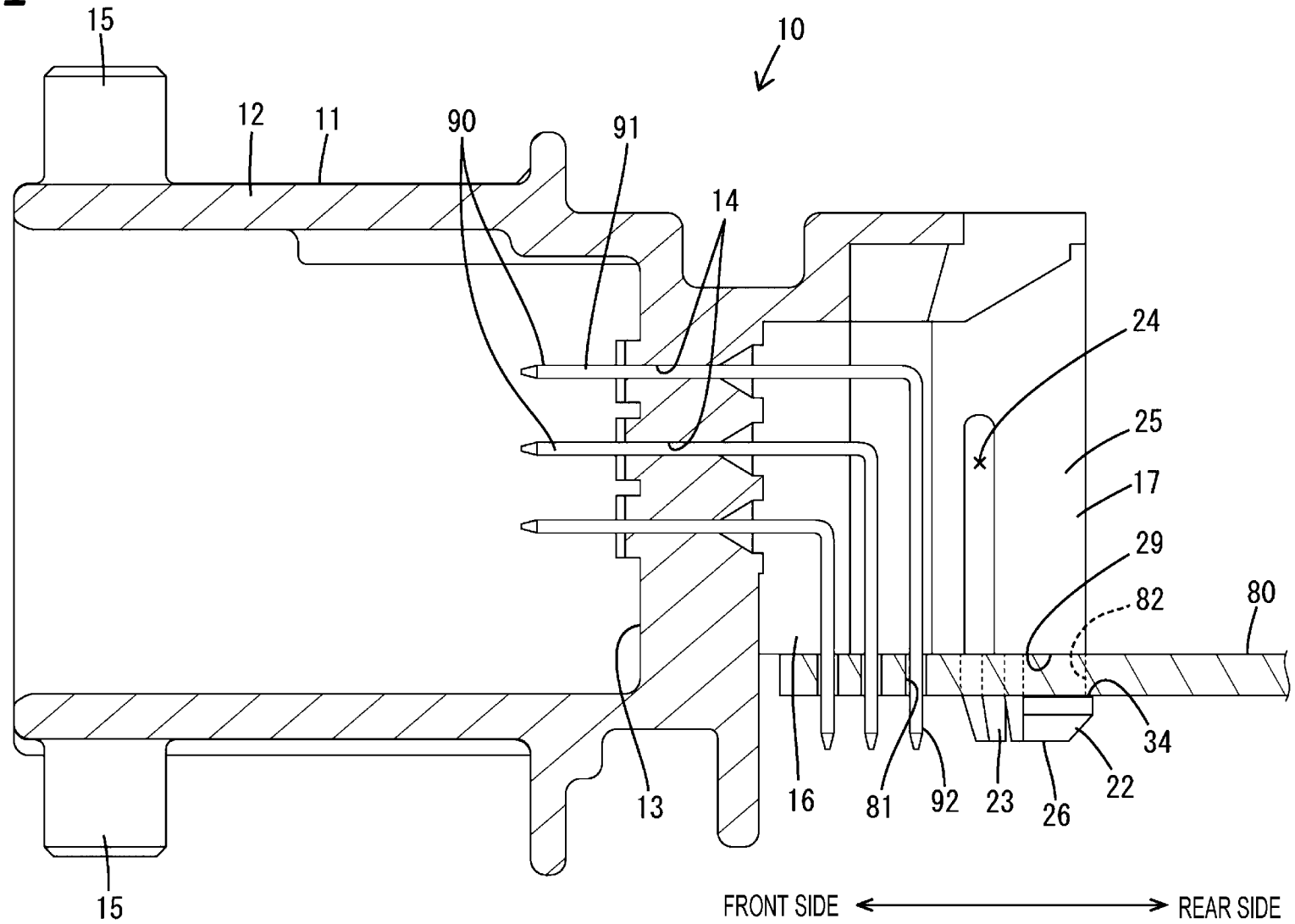
FIG. 1 is a section showing a state where a connector is installed on a circuit board in one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure includes a housing to be installed on a circuit board, wherein the housing includes a plurality of locking portions, each of the plurality of locking portions includes a resiliently deformable leg portion projecting from a front side to a back side of the circuit board and a locking body protruding from the leg portion in a direction intersecting a projecting direction of the leg portion, the locking body has a locking surface lockable to the circuit board, and the plurality of locking portions come in a plurality of types having the locking surfaces at different heights in the projecting direction.

According to this configuration, when a plate thickness of the circuit board changes in a tolerance range, the locking surface of any one of the locking portions can realize a state lockable to the circuit board. As a result, the locking portion(s) can be properly locked to the circuit board and the inclination of the housing with respect to the circuit board can be suppressed.

(2) Preferably, the plurality of types of the locking portions include a first locking portion and a second locking portion, the locking surface of the second locking portion is located more toward a tip side in the projecting direction than the locking surface of the first locking portion, and when $\alpha$ denotes an angle of inclination between the locking surface of the first locking portion and an axis of the first locking portion in the projecting direction and $\beta$ denotes an angle of inclination between the locking surface of the second locking portion and an axis of the second locking portion in the projecting direction, at least the angle of inclination $\alpha$ is an obtuse angle and the angles of inclination $\alpha$, $\beta$ satisfy a relationship of $\beta<\alpha$.

According to this configuration, the locking surface of the first locking portion is effectively locked to the circuit board, for example, if the plate thickness of the circuit board is small in the tolerance range. Further, the locking surface of the second locking portion is effectively locked to the circuit board, for example, if the plate thickness of the circuit board is large in the tolerance range.

Particularly, since the relationship of $\beta<\alpha$ is satisfied, the locking surface of the second locking portion can realize a state firmly locked to the back of the circuit board if the plate thickness of the circuit board is large. Further, when the plate thickness of the circuit board changes in the tolerance range, the locking surface of the first locking portion can realize a state facing the back side of the circuit board. As a result, a state where the locking portion is properly locked to the circuit board can be more satisfactorily realized.

(3) The housing may include a projection for positioning with respect to the circuit board, and the plurality of locking portions and the projection may form a lock portion as a set and be separately arranged about an axial center passing through a center of the lock portion.

According to this configuration, position shifts of the locking portions with respect to the circuit board can be restricted by the projection when the plurality of locking portions are locked to the circuit board.

(4) A pair of the lock portions may be arranged on both end sides in the width direction of the housing, the plurality of types of the lock portions include a first locking portion and a second locking portion, the locking surface of the second locking portion may be located more toward a tip side in the projecting direction than the locking surface of the first locking portion, and the first locking portion may be located outwardly of the second locking portion in the width direction and protrudes outward in the width direction in the housing.

According to this configuration, a state where the locking surface of the first locking portion is locked to the circuit board can be maintained even if the circuit board is curved by receiving an external force, for example, when the plate thickness of the circuit board is small in the tolerance range.

(5) The housing may include a receptacle open forward and a projecting wall projecting rearward from the receptacle, the lock portion may be provided on the projecting wall and the projection may be located forward of the plurality of locking portions.

According to this configuration, the receptacle possibly projects further forward than the front end of the circuit board, but the inclination of the receptacle toward a front-lower side can be effectively suppressed since the projection for positioning is located forward of the respective locking portions.

Details of Embodiment of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

As shown in FIG. 1, a connector 10 of one embodiment includes a plurality of terminal fittings 90 and a housing 11 into which the respective terminal fittings 90 are to be mounted. Note that, in the following description, a left side of FIG. 1 is referred to as a front side concerning a front-rear direction. A vertical direction is based on a vertical direction of each figure except FIG. 3. A lateral direction is synonymous with a width direction and based on a lateral direction of each figure except FIG. 1. The housing 11 is connectable to an unillustrated mating housing from front.

(Terminal Fittings)

The terminal fitting 90 is made of conductive metal and configured as a pin-like or tab-like male terminal fitting. As shown in FIG. 1, the terminal fitting 90 is L-shaped in a side view and includes a horizontal portion 91 extending in the front-rear direction and a vertical portion 92 extending in the vertical direction. A front end part of the horizontal portion 91 is connected to an unillustrated mating terminal fitting mounted in the mating housing when the housing 11 is connected to the mating housing. A lower end part of the vertical portion 92 is inserted into a connection hole 81 provided in a circuit board 80 and connected to the circuit board 80 by soldering.

(Housing)

The housing 11 is made of synthetic resin and includes, as shown in FIG. 1, a receptacle 12 open forward. The receptacle 12 is in the form of a rectangular tube long in the lateral direction, and the mating housing is fit thereinto. A plurality of mounting holes 14 are provided to penetrate through a back wall 13 of the receptacle 12. The horizontal portion 91 of the terminal fitting 90 is press-fit and inserted into the mounting hole 14. The front end part of the horizontal portion 91 is arranged to project into the receptacle 12.

A pair of cam followers 15 are provided to project on the outer surfaces of upper and lower walls of the receptacle 12. Each of both cam followers 15 has a cylindrical shape and is engaged with an unillustrated lever to be assembled with the mating housing to proceed with the connection of the housing 11 and the mating housing.

Figure 2:
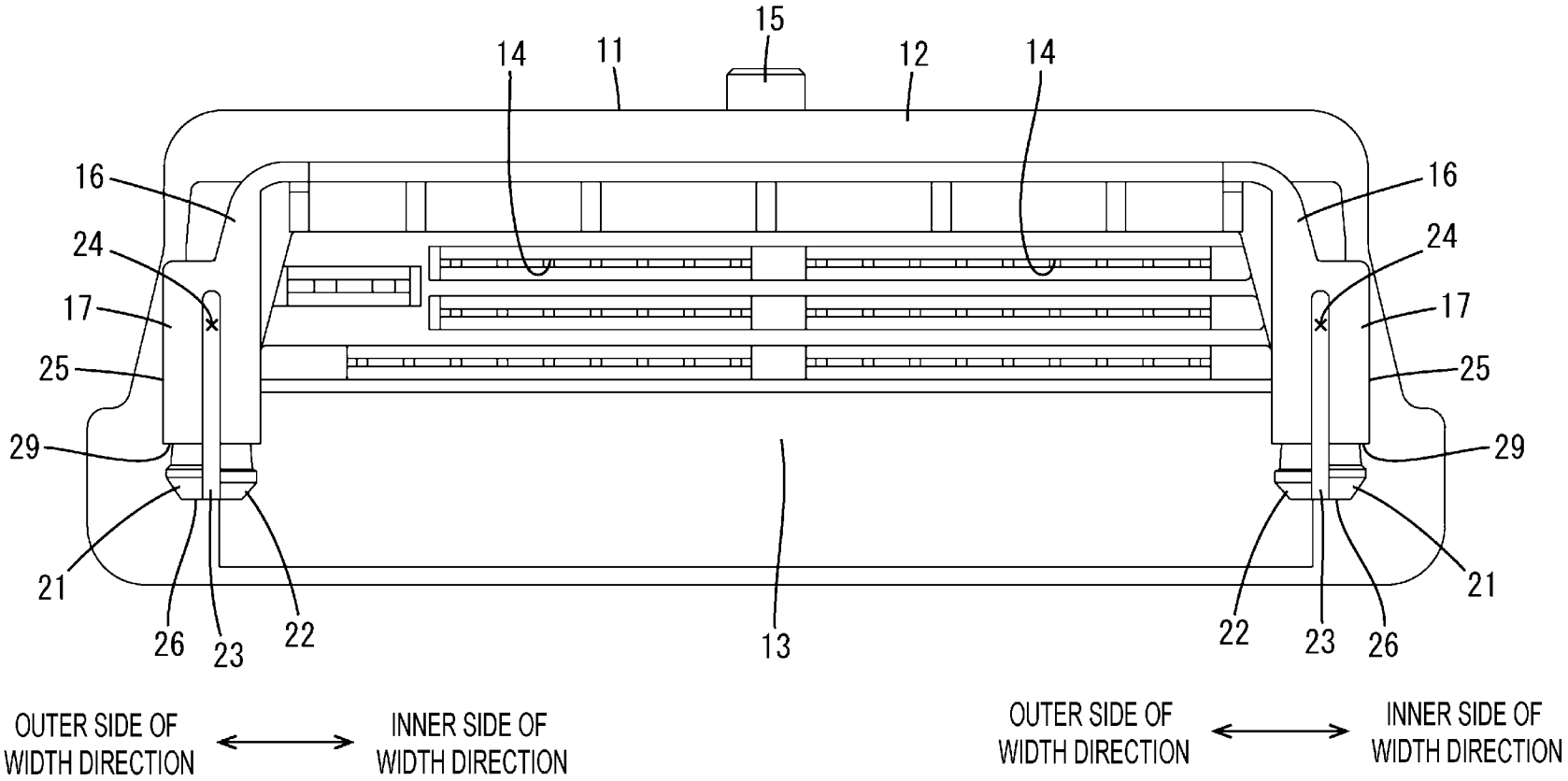
FIG. 2 is a back view of a housing.

As shown in FIG. 2, the housing 11 includes a pair of projecting walls 16 projecting rearward from both widthwise end sides of the back wall 13 of the receptacle 12. The both projecting walls 16 are in the form of plates along the vertical direction. The both projecting walls 16 are arranged to cover the respective terminal fittings 90 pulled out from the back wall 13 of the receptacle 12 from lateral sides. That is, the both projecting walls 16 protect the respective terminal fittings 90 from the lateral sides. The lower surfaces of the both projecting walls 16 are arranged along the front-rear direction. As shown in FIG. 1, the lower surface of the projecting wall 16 is arranged above the lower surface of the receptacle 12.

The housing 11 includes a pair of lock portions 17 behind the both projecting walls 16. The both lock portions 17 are respectively inserted into locking holes 82 provided in the circuit board 80 to be locked. The locking holes 82 form circular openings in the circuit board 80. The both lock portions 17 are arranged behind and away from the housing 11 in a rearmost end part of the connector 10.

The lock portion 17 has a cylindrical shape as a whole and includes, as shown in FIG. 1, a body portion 25 in a range overlapping the projecting wall 16 in the vertical direction. The body portion 25 is integrally coupled to the projecting wall 16 along the vertical direction. The lock portion 17 has a tip part 26 below the body portion 25.

Figure 3:
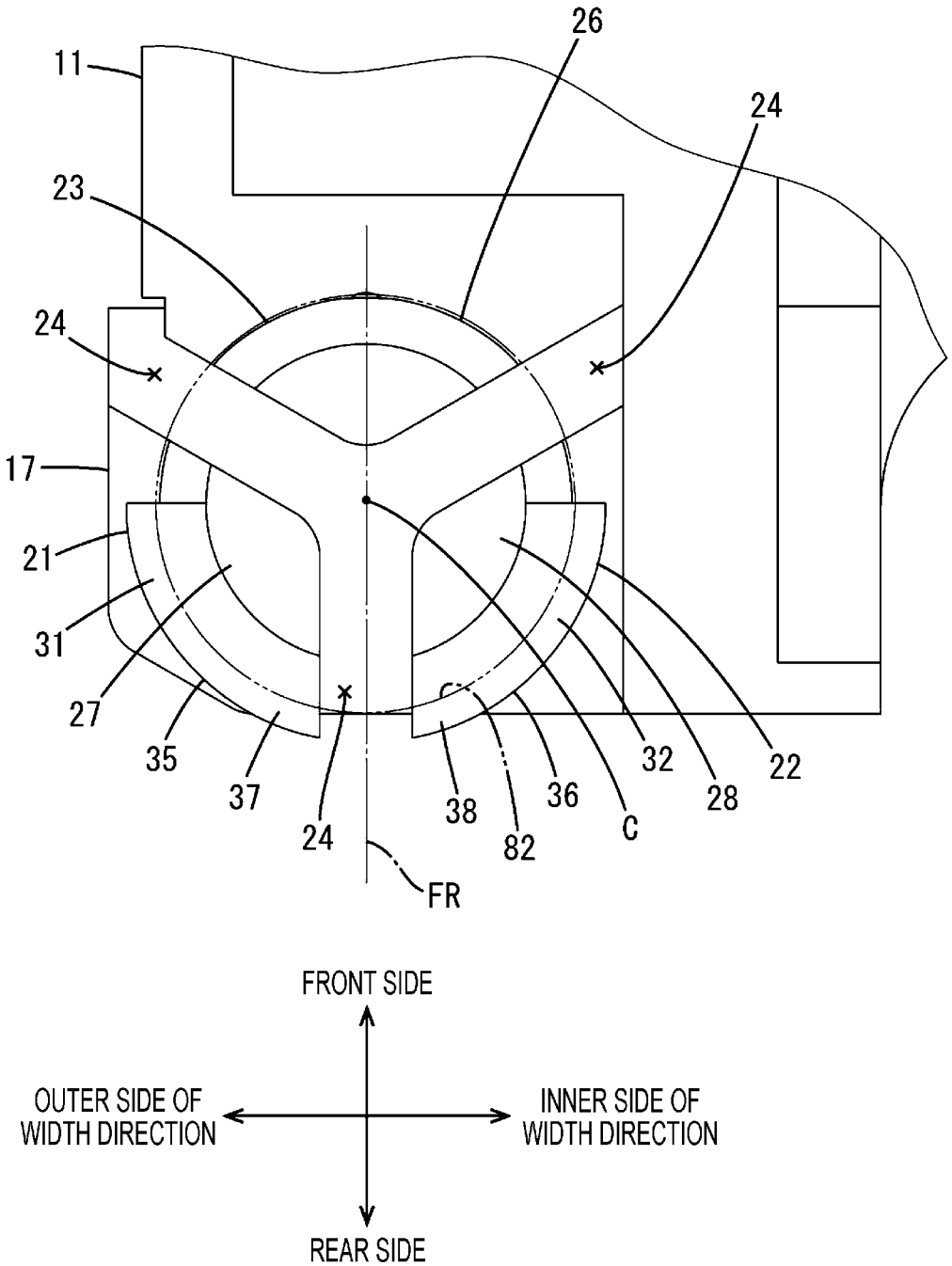
FIG. 3 is an enlarged bottom view showing a lock portion on one end side of the housing.

A first locking portion 21, a second locking portion 22 and a projection 23 are provided on the tip part 26 of the lock portion 17. As shown in FIG. 3, the first and second locking portions 21, 22 and the projection 23 are provided side by side in a circumferential direction about an axial center C passing through a radial center of the lock portion 17. The first and second locking portions 21, 22 and the projection 23 are fan-shaped in a bottom view and separated from each other via slits 24. The slits 24 are formed at an interval of 120° ($2\pi/3$ radians) in the circumferential direction, and communicate via the axial center C of the lock portion 17.

As shown in FIGS. 1 and 2, the slits 24 are provided to be long in the vertical direction from the body portion 25 to the tip part 26.

The first and second locking portions 21, 22 have a common structure. Specifically, as shown in FIG. 4, the first and second locking portions 21, 22 include leg portions 27, 28 projecting downward from the body portion 25 and locking bodies 31, 32 protruding radially outward (toward sides intersecting a projecting direction of the leg portions 27, 28) from lower parts of the leg portions 27, 28.

Base ends of the leg portions 27, 28 are reduced in diameter than the body portion 25 via stepped surfaces 29. As shown in FIG. 1, the stepped surface 29 is arranged along the surface of the circuit board 80 when the housing 11 is mounted on the circuit board 80. The leg portions 27, 28 are resiliently deformable in a radial direction (width direction) with the base ends thereof as fulcrums.

As shown in FIG. 2, the both lock portions 17 are arranged in a pair on both widthwise end sides in the housing 11. The first locking portions 21 of the both lock portions 17 are arranged outwardly of the housing 11 in the width direction with respect to the second locking portions 22. The second locking portions 22 of the both lock portions 17 are arranged inwardly of the housing 11 in the width direction with respect to the first locking portions 21. As shown in FIG. 3, the first and second locking portions 21, 22 are line-symmetrically arranged with respect to a front-rear axis FR passing through the radial center of the lock portion 17.

Figure 4:
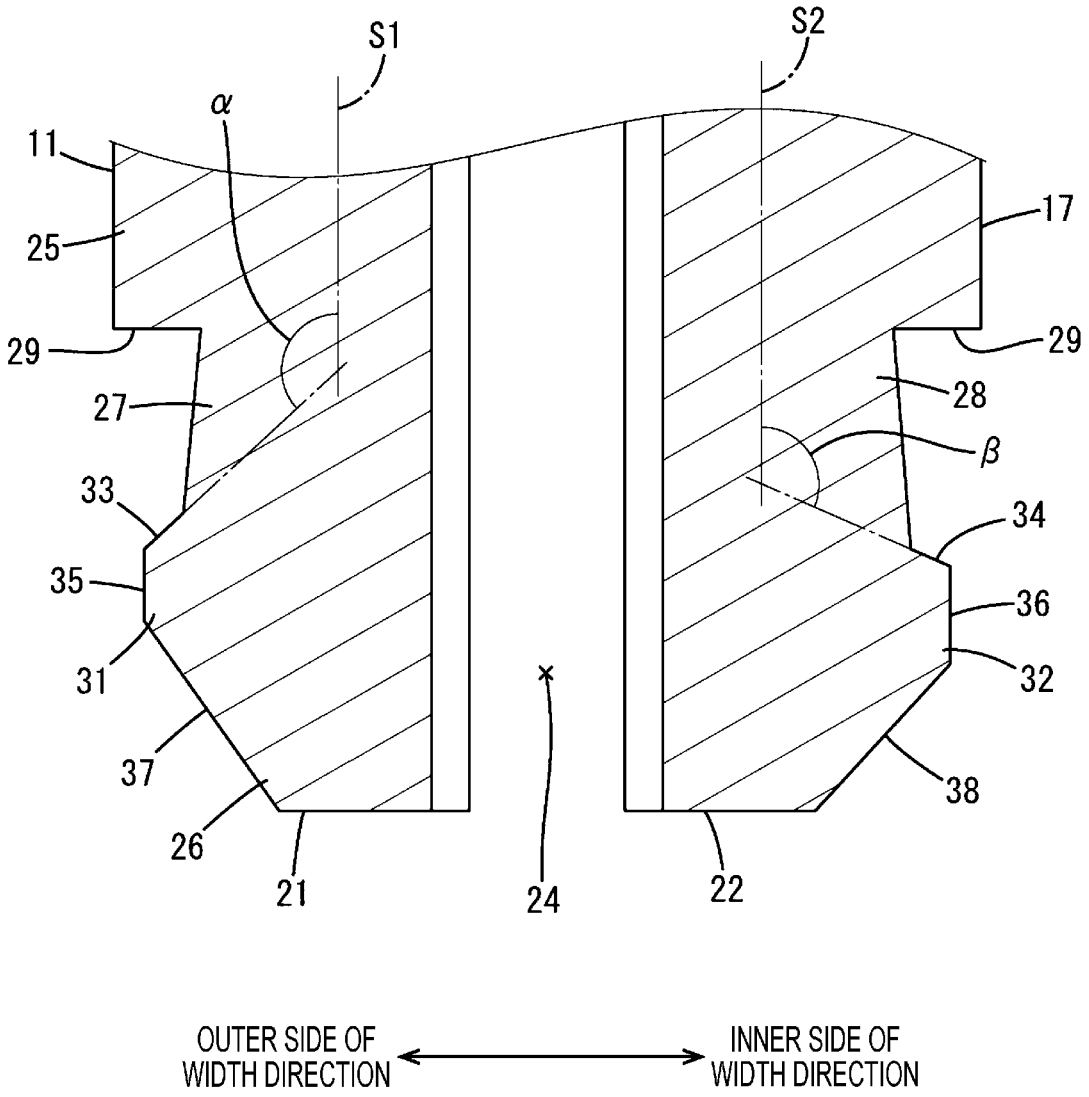
FIG. 4 is an enlarged section showing a state where a first locking portion and a second locking portion are arranged in a natural state.

As shown in FIG. 4, when the leg portion 27 of the first locking portion 21 and the leg portion 28 of the second locking portion 22 are in a natural state, the outer peripheral surfaces of the leg portions 27, 28 are at an acute angle to the stepped surfaces 29 and inclined with respect to the vertical direction. The inner surfaces of the leg portions 27, 28 are arranged along the vertical direction and define the slit 24. In short, the leg portions 27, 28 are shaped to be widened toward a lower side. The lower surfaces of the leg portions 27, 28 are flat surfaces along the width direction, and arranged at the same height position in the first and second locking portions 21, 22.

As shown in FIG. 4, the locking body 31, 32 has a locking surface 33, 34 connected to the outer surface of the leg portion 27, 28. The locking surface 33, 34 is a tapered slope facing upward and arranged in a direction intersecting the vertical direction and radial direction.

Here, the first and second locking portions 21, 22 are so configured that the locking surfaces 33, 34 are at different heights in the vertical direction (projecting direction of the leg portions 27, 28). Specifically, the locking surface 33 of the first locking portion 21 is arranged to be higher than the locking surface 34 of the second locking portion 22.

An angle of inclination $\alpha$ of the locking surface 33 from a base end side of the leg portion 27 with respect to a vertical axis S1 of the leg portion 27 is an obtuse angle. An angle of inclination $\beta$ of the locking surface 34 from a base end side of the leg portion 28 with respect to a vertical axis S2 of the leg portion 28 is also an obtuse angle. In the case of this embodiment, the angles of inclination $\alpha$, $\beta$ satisfy a relationship of $\beta<\alpha$. A length in an inclination direction of the locking surface 33 is longer than that of the locking surface 34.

The outer surface of the locking body 31, 32 is configured as an outer surface portion 35, 36 along the vertical direction. As shown in FIG. 3, the outer surface portion 35, 36 has an arc shape, in particular a quarter arc shape, in a bottom view. A vertical length of the outer surface portion 35 of the first locking portion 21 is shorter than that of the outer surface portion 36 of the second locking portion 22. A slope portion 37, 38 inclined downward is provided between the outer surface portion 35, 36 and the lower surface of the leg portion 27, 28. A length in an inclination direction of the slope portion 37 of the first locking portion 21 is longer than that of the slope portion 38 of the second locking portion 22.

As shown in FIG. 3, the projection 23 is set to be located relatively forward of the first and second locking portions 21, 22. The outer surface of the projection 23 is arranged along an arc concentric with the axial center C of the lock portion 17 as a whole. The outer surface of the projection 23 is arranged along the inner surface of the locking hole 82 of the circuit board 80 with the lock portion 17 inserted in the locking hole 82. The lower surface of the projection 23 and those of the leg portions 27, 28 are arranged at the same height position in the vertical direction (see FIG. 2).

(Installation Method of Housing on Circuit Board and Installation Structure)

The housing 11 is mounted on the surface of the circuit board 80 from above. In the process of lowering the housing 11, the respective locking bodies 31, 32 of the both lock portions 17 slide in contact with the opening edges of the locking holes 82 in the surface of the circuit board 80, whereby the first and second locking portions 21, 22 are resiliently deformed toward the axial centers C of the lock portions 17 with the base ends of the leg portions 27, 28 as fulcrums. During this time, the outer surfaces of the projections 23 slide in contact with the inner surfaces of the locking holes 82 to suppress the deviation of the axial centers C of the lock portions 17. The projections 23 are inserted into front sides inside the locking holes 82 and the first and second locking portions 21, 22 are inserted into rear sides inside the locking holes 82 (see FIG. 1).

Figure 5:
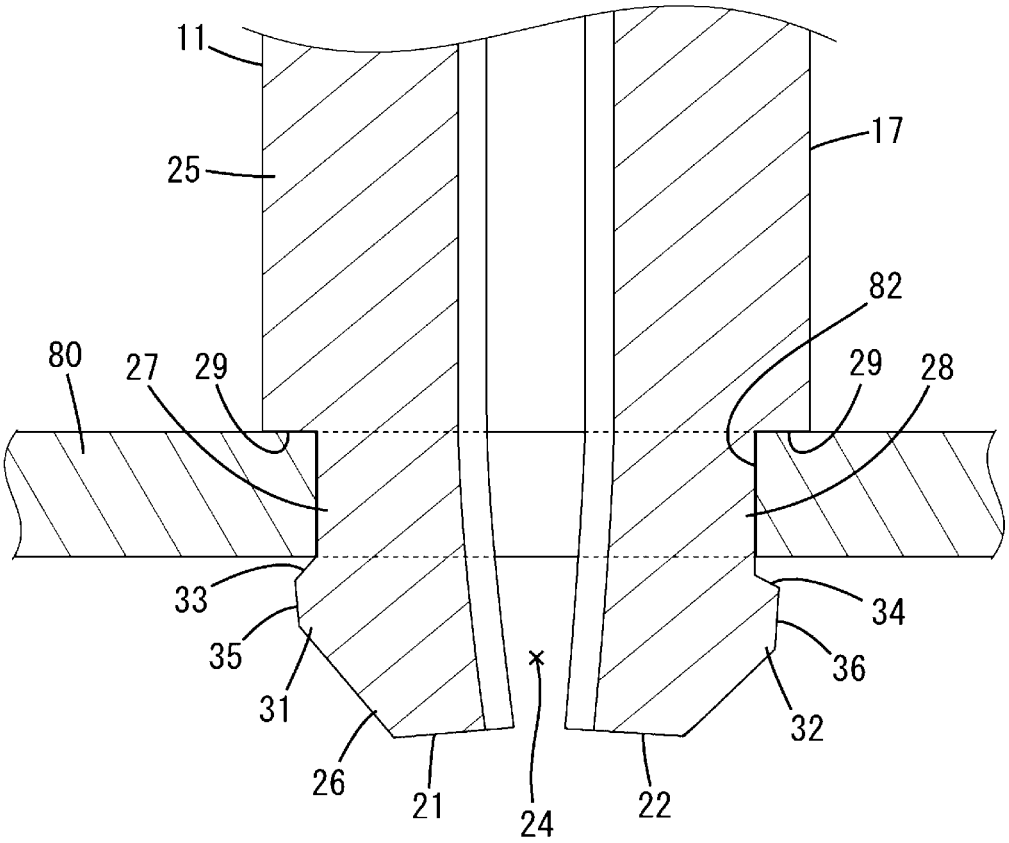
FIG. 5 is an enlarged section showing a state where locking surfaces of the respective first and second locking portions are arranged to be lockable to a back side of the circuit board when a plate thickness of the circuit board is small in a tolerance range.
Figure 6:
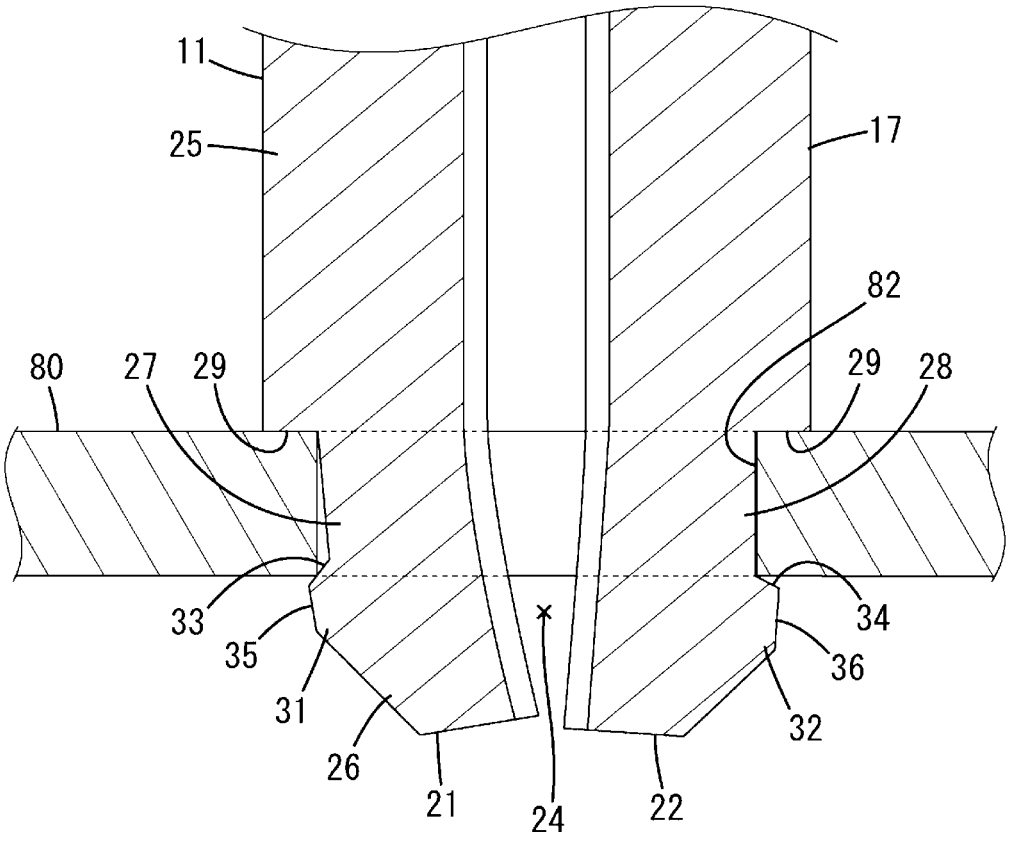
FIG. 6 is an enlarged section showing a state where the locking surfaces of the respective first and second locking portions are arranged to be lockable to the back side of the circuit board when the plate thickness of the circuit board is large in the tolerance range.

The descent of the housing 11 is stopped when the lower surfaces of the both projecting walls 16 and the stepped surfaces 29 of the both lock portions 17 are positioned to contact the surface of the circuit board 80 and the both projecting walls 16 are placed on the surface of the circuit board 80. At this time, the first and second locking portions 21, 22 are displaced in resilient return directions away from the axial centers C of the lock portions 17 and, as shown in FIGS. 5 and 6, the entire outer surface portions 35, 36 are arranged to be located on the back side of the circuit board 80. The first and second locking portions 21, 22 do not completely resiliently return and the leg portions 27, 28 are deflected and deformed in an arcuate manner.

For example, if a plate thickness of the circuit board 80 has a minimum value in a tolerance range as shown in FIG. 5, the locking surfaces 33, 34 of the respective first and second locking portions 21, 22 are entirely arranged to face and be lockable to the back of the circuit board 80. The leg portions 27, 28 of the respective first and second locking portions 21, 22 are resiliently deformed by the same deflection amount to give resilient forces to the circuit board 80. The locking surface 33 of the first locking portion 21 is arranged closer to the back of the circuit board 80 than the locking surface 34 of the second locking portion 22.

In contrast, if the plate thickness of the circuit board 80 has a maximum value in the tolerance range as shown in FIG. 6, the locking surface 33 of the first locking portion 21 is arranged to contact and be lockable to the opening edge of the locking hole 82 on the back of the circuit board 80. The locking surface 34 of the second locking portion 22 is arranged to face and be lockable to the back of the circuit board 80. The leg portion 27 of the first locking portion 21 is deflected and deformed more than the leg portion 28 of the second locking portion 22. Thus, the first locking portion 21 gives a large resilient force to restrict the upward escape of the housing 11 to the circuit board 80 via the locking surface 33. The second locking portion 22 causes the entire locking surface 34 to face the back of the circuit board 80 while giving a resilient force to the circuit board 80.

As just described, in the case of this embodiment, regardless of how the plate thickness of the circuit board 80 changes in the tolerance range, the first and second locking portions 21, 22 can exhibit a locking function for the circuit board 80. As a result, the housing 11 obtains the locking function of the first and second locking portions 21, 22 and is mounted in a retained state on the circuit board 80 with good reliability.

With the housing 11 mounted on the circuit board 80, the receptacle 12 is arranged in a floating state in front of the circuit board 80 as shown in FIG. 1. If the first and second locking portions 21, 22 are loosely locked to the circuit board 80, the housing 11 may be so inclined that a front side of the receptacle 12 is lowered. However, in the case of this embodiment, since the locking function of the first and second locking portions 21, 22 can be exhibited as described above even if the plate thickness of the circuit board 80 changes in the tolerance range, the inclination of the housing 11 with respect to the circuit board 80 can be suppressed. Particularly, since the projections 23 for positioning are located forward of the first and second locking portions 21, 22, it can be effectively suppressed that the front side of the receptacle 12 is lowered.

Further, since the angle of inclination $\alpha$ of the locking surface 33 of the first locking portion 21 is larger than the angle of inclination $\beta$ of the locking surface 34 of the second locking portion 22 according to this embodiment, a state where the locking surface 33 of the first locking portion 21 is locked into contact with the opening edge of the locking hole 81 on the back of the circuit board 80 can be realized when the plate thickness of the circuit board 80 changes. If the plate thickness of the circuit board 80 is large, a state where the locking surface 34 of the second locking portion 22 is firmly locked to the back of the circuit board 80 can be realized.

Further, in the case of this embodiment, the first locking portion 21, the second locking portion 22 and the projection 23 for positioning form the lock portion 17 as a set and are arranged separately about the axial center C passing through the radial center of the locking portion 17. Thus, position shifts of the first and second locking portions 21, 22 with respect to the circuit board 80 can be suppressed by the projection 23 in the process of inserting the first and second locking portions 21, 22 into the locking hole 82 of the circuit board 80.

Furthermore, in the case of this embodiment, the first locking portion 21 is located outwardly of the second locking portion 22 in the width direction and protrudes outward in the width direction in the housing 11. Thus, if the plate thickness of the circuit board 80 is small in the tolerance range, a state where the locking surface 33 of the first locking portion 21 is locked to the circuit board 80 can be satisfactorily maintained, for example, even if the circuit board 80 is curved by receiving an external force.

Other Embodiments of Present Disclosure

The embodiment disclosed this time should be considered illustrative in all aspects, rather than restrictive.

Although two types of the locking portions composed of the first and second locking portions are provided in the case of the embodiment, three or more types of locking portions may be provided by including other locking portion(s) having locking surface(s) at different heights in the vertical direction (projecting direction of the leg portions) in addition to the first and second locking portions as another embodiment.

Although the first locking portion, the second locking portion and the projection constitute the lock portion as a set in the case of the embodiment, the projection may be omitted from the lock portion as another embodiment. Further, the first and second lock portions may be arranged at a large distance from each other without constituting the lock portion.

Although the angle of inclination $\beta$ of the locking surface of the second locking portion with respect to the axis of the leg portion is an obtuse angle in the case of the embodiment, the angle of inclination $\beta$ may be a right angle or actuate angle as another embodiment.

Although the terminal fittings of a through-hole type to be inserted into the connection holes of the circuit board and soldered and connected are provided in the case of the embodiment, terminal fittings of a surface-mount type to be soldered and connected to a surface of a circuit board may be provided as another embodiment.

Although the lock portions are provided behind the receptacle in the case of the embodiment, lock portions may be provided laterally to a receptacle as another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising a housing to be installed on a circuit board, wherein:

the housing includes a plurality of locking portions, each of the plurality of locking portions includes a resiliently deformable leg portion projecting from a front side to a back side of the circuit board and a locking body protruding from the leg portion in a direction intersecting a projecting direction of the leg portion, the locking body has a locking surface lockable to the circuit board, each of the plurality of locking portions has the locking surface positioned at different heights in the projecting direction, the plurality of locking portions include a first locking portion and a second locking portion, the locking surface of the second locking portion is located more toward a tip side in the projecting direction than the locking surface of the first locking portion, and when $\alpha$ denotes an angle of inclination between the locking surface of the first locking portion and an axis of the first locking portion in the projecting direction and $\beta$ denotes an angle of inclination between the locking surface of the second locking portion and an axis of the second locking portion in the projecting direction, at least the angle of inclination $\alpha$ is an obtuse angle and the angles of inclination $\alpha$, $\beta$ satisfy a relationship of $\beta<\alpha$.

2. The connector of claim 1, wherein:

the housing includes a projection for positioning with respect to the circuit board, and the plurality of locking portions and the projection form a lock portion as a set and are separately arranged about an axial center passing through a center of the lock portion.

3. The connector of claim 2, wherein:

a pair of the lock portions are arranged on both end sides in a width direction of the housing, the plurality of lock portions include a first locking portion and a second locking portion, the locking surface of the second locking portion is located more toward a tip side in the projecting direction than the locking surface of the first locking portion, and the first locking portion is located outwardly of the second locking portion in the width direction and protrudes outward in the width direction in the housing.

4. The connector of claim 2, wherein the housing includes a receptacle open forward and a projecting wall projecting rearward from the receptacle, the lock portion is provided on the projecting wall and the projection is located forward of the plurality of locking portions.

5. The connector of claim 1, wherein the locking surface is connected to an outer surface of the leg portion.

6. The connector of claim 1, wherein the locking surface is a tapered slope facing upward.

7. The connector of claim 1, wherein the locking surface of each of the plurality of locking portions is entirely arranged to face and be lockable to a back of the circuit board when the housing is mounted on a surface of the circuit board.

* * * * *